US005650773A

United States Patent [19]

Chiarello

[11] Patent Number: 5,650,773

[45] Date of Patent: *Jul. 22, 1997

[54] MULTI-FUNCTIONAL INTRUSION WARNING SYSTEM FOR BRANCH CIRCUITS OF A HOME AND THE LIKE

[76] Inventor: Frank Anthony Chiarello, 3229 N. Ricardo Cir., Mesa, Ariz. 85215

[ * ] Notice: The term of this patent shall not extend beyond the expiration date of Pat. No. 5,506,574.

[21] Appl. No.: 622,289

[22] Filed: Mar. 25, 1996

Related U.S. Application Data

[63] Continuation-in-part of Ser. No. 435,755, May 5, 1995, Pat. No. 5,506,574.

[51] Int. Cl.[6] ..... G08B 23/00; G08B 1/08

[52] U.S. Cl. ..... 340/691; 307/39; 307/116; 340/533; 340/538; 361/170

[58] Field of Search ..... 340/691, 533, 340/538; 307/39, 116; 361/170

[56] References Cited

U.S. PATENT DOCUMENTS

| | | | |
|---|---|---|---|
| 4,074,269 | 2/1978 | Hartley | 340/825.37 |
| 4,514,729 | 4/1985 | Szarka | 340/825.06 |
| 4,906,858 | 3/1990 | Gesin | 307/11 |
| 4,982,176 | 1/1991 | Schwarz | 340/567 |
| 5,015,994 | 5/1991 | Hoberman et al. | 340/567 |
| 5,061,997 | 10/1991 | Rea et al. | 348/143 |
| 5,086,385 | 2/1992 | Launey et al. | 364/188 |
| 5,128,654 | 7/1992 | Griffin et al. | 340/567 |
| 5,130,613 | 7/1992 | Szuba | 315/291 |
| 5,136,213 | 8/1992 | Sacchetti | 315/159 |
| 5,142,199 | 8/1992 | Elwell | 315/154 |
| 5,225,806 | 7/1993 | Stanley-Arslanok et al. | 340/541 |
| 5,349,330 | 9/1994 | Diong et al. | 340/567 |
| 5,506,574 | 4/1996 | Chiarello | 340/691 |

*Primary Examiner*—Glen Swann
*Attorney, Agent, or Firm*—John D. Lister

[57] ABSTRACT

A multi-functional intrusion warning system is used directly in the conventional circuitry of a building such as a home, small business or the like, having a conventional AC power source, a plurality of branch circuits and a circuit breaking means (located intermediate the power source and the branch circuits for interrupting the current to any branch circuit experiencing a current surge) to provide the building with a means of controlling the current to certain or all of the branch circuits which enables the power to be cut off to these branch circuits and then turned back on due to an occurrence detected by a motion, sound, smoke, heat, and/or telephone call activated or similar detection device. The lighting, alarms, and/or other electrical devices on these branch circuits are activated when the detection device activates the control unit of the intrusion warning system.

21 Claims, 3 Drawing Sheets

MULTI-FUNCTIONAL INTRUSION WARNING SYSTEM FOR BRANCH CIRCUITS OF A HOME AND THE LIKE

This patent application is a continuation-in-part of patent application Ser. No. 08/435,755; filed May 5, 1995; which issued on Apr. 9, 1996, as U.S. Pat. No. 5,506,574.

BACKGROUND OF THE INVENTION

The present invention is directed to a multi-functional intrusion warning or alert system which can be used to cut off and turn on current to selected branch circuits of a building, such as a residence, small business, trailer, mobile home, and the like, and, in particular, to a multi-functional intrusion warning or alert system which can be incorporated right into the conventional circuitry of the building without having to rewire the building or modify the existing circuitry.

Currently, security alarm and intrusion systems are available for use in homes and the like which are operated by an AC or DC current and require an AC to DC transformer and special low voltage wiring in the building which is expensive and time consuming to install. In addition, once the system is installed, the system can not be readily changed or modified by the building owner or homeowner without the necessity of rewiring the system. Thus, for all practical purposes, the owner is locked into the system as installed. Other systems currently in use rely on sophisticated computers or other control systems, such as solid state circuit boards, to operate the system or are solar powered and require the installation of solar panels and the like.

SUMMARY OF THE INVENTION

The present invention provides a solution to the problems associated with security alarm and intrusion systems of the prior art by providing a simple, inexpensive, flexible multi-functional intrusion warning system which can be retro-fitted into or originally installed as part of the conventional circuitry of a residence, small business, mobile home, or similar buildings having a conventional power source such as 120 volt AC or other conventional AC power source. Such buildings normally have a service panel to which the AC power source is connected and a plurality of branch circuits associated with the building which provide electricity to various rooms and locations internally and externally of the building. The service panel contains a plurality of fuses or circuit breakers with one of the fuses or circuit breakers being located in the circuitry of the building intermediate the power source and each of the branch circuits. If the current in any part of a branch circuit surges to a dangerously high level a fuse will melt to break the circuit or a circuit breaker, using an electromagnetic switch activated by the current surge, will open to break the circuit.

The multi-functional intrusion warning system of the present invention is located in the building circuitry intermediate the fuses or circuit breakers of the service panel and one or more or all of the branch circuits. Preferably, when the multi-functional intrusion warning system is retro-fitted to a building such as a residence, the housing or box containing the multi-functional control unit of the system is located adjacent the service panel (e.g. inside the garage) to simplify the inclusion of the multi-functional intrusion warning system into the existing AC circuitry of the building. However, in new construction, the multi-functional control unit of the intrusion warning system can be located within the service panel, within a box or housing in the garage or within the residence or building for the convenience of the owner.

Preferably, for greater flexibility, all or at least a plurality of branch circuits in a building are controlled by the multi-functional control unit of the multi-functional intrusion warning system of the present invention. However, the number of branch circuits in the building circuitry controlled by the multi-functional control unit of the multi-functional intrusion warning system is optional ranging from one to all of the branch circuits. One embodiment of the multi-functional control system permits any or all of the entire branch circuits normally controlled by the multi-functional control unit of the intrusion warning system to by-pass the multi-functional control unit of the intrusion warning system to provide even greater flexibility.

In a first embodiment of the multi-functional control unit of the intrusion warning system of the present invention, the multi-functional control unit has current interrupting means (e.g. a normally closed contactor unit with multiple sets of contacts) in the building circuit intermediate the fuses or circuit breakers of the service panel and each of the branch circuits on the control system. When the contactor unit is in its normally de-energized state, the contacts in the unit are closed and complete the circuits to the branch circuits so that current flows through the contactor unit to the branch circuits on the intrusion warning system. When the contactor unit is energized, the contacts in the unit are opened breaking or interrupting the circuits to the branch circuits on the intrusion warning system.

An arming switch is provided in the multi-functional control unit of the intrusion warning system to energize the contactor unit and arm the system. When closed, the arming switch completes the circuit to the contactor unit through a control relay having normally closed contacts (preferably, using the existing AC power source to the building) and energizes a coil of the contactor unit to open the contacts of the contactor unit, thereby de-energizing all of the branch circuits on the intrusion warning system.

The multi-functional intrusion warning system is also provided with one or more occurrence detection units such as, but not limited to, motion, sound, smoke, infrared, photocell, radio signal or telephone activated detection units which can be mounted in the garage or at various locations within and outside the building. When the occurrence is detected by the detection unit, the circuit through the detection unit is closed sending power to the coil of the control relay which changes the state of the normally closed contacts of the relay to open. This interrupts the circuit to the coil of the contactor unit and the contactor unit is de-energized. When the contactor unit is de-energized, the circuits are completed to all of the branch circuits on the intrusion warning system and current flows to all of the branch circuits and any lights, appliances, alarms, or other electrical devices on any of the branch circuits. Thus, electrical devices on the branch circuits, which were turned on when the branch circuits were shut off by the arming of the multi-functional control unit of the intrusion warning system, will come back on when the occurrence detection unit detects an occurrence.

This feature of the multi-functional intrusion warning system gives the occupant of the building, such as a homeowner, the option of turning on or plugging in selected lights, televisions, radios, appliances, plug-in alarm devices, pulse lights and/or other electrical devices, associated with the branch circuits of the intrusion warning system, prior to arming the multi-functional control unit of the intrusion warning system and leaving the building or going to sleep, etc. The electrical devices left on or turned off on the branch circuits is at the discretion of the occupant and can be varied each time the multi-functional intrusion warning system is armed. Once the desired devices on the branch circuits are turned on, the occupant arms the multi-functional control unit of the intrusion warning system thereby turning off the current to these branch circuits and turning off the electrical devices on the branch circuits. Upon the detection of an occurrence, e.g. a motion detector detecting an intruder or the occupant returning to the building, current is returned to the branch circuits on the system and the electrical devices, such as lights, come back on to frighten away an intruder or to provide light for the returning occupant. In this example, if upon returning to the building, the occupant sees that the lights are already turned on, the occupant will know that something or someone has activated the intrusion warning system and the occupant can then take the necessary precautionary measures. If the intrusion warning system has not been activated in the occupant's absence, the intrusion warning system can also function as a convenience device for the occupant. Upon the occupant's return home, the occurrence detector (e.g. a motion detector detecting the motion of the occupant or the raising of the garage door or a telephone or signal activated occurrence detector activated by a telephone call or a hand held control unit) activates the intrusion warning system to light the house for the occupant before the occupant enters the house.

In a second embodiment of the multi-functional control unit of the intrusion warning system of the present invention, the multi-functional control unit has current interrupting means (e.g. a normally open contactor unit with multiple sets of contacts) in the building circuit intermediate the fuses or circuit breakers of the service panel and each of the branch circuits on the control system. When the contactor unit is in its normally de-energized state, the contacts in the unit are open and interrupt the circuits to the branch circuits so that current can not flow through the contactor unit to the branch circuits on the intrusion warning system. When the contactor unit is energized, the contacts in the contactor unit are closed and complete the circuits to the branch circuits on the intrusion warning system so that current can flow through the contactor unit to the branch circuits on the intrusion warning system.

This second embodiment of the multi-functional intrusion warning system is also provided with one or more occurrence detection units such as, but not limited to, motion, sound, smoke, infrared, photocell, radio signal or telephone activated detection units which can be mounted in the garage or at various locations within and outside the building. The multi-functional intrusion warning system is armed by energizing one or more of these occurrence detection units. When an occurrence is detected by a detection unit, the circuit through the detection unit is closed completing the circuit to the coil of the contactor unit directly through the detection unit or completing the circuit to the coil of the contactor unit by energizing a coil of a control relay to cause its contacts to close and thereby complete the circuit to the coil of the contactor unit which changes the state of the normally open contacts of the contactor unit to closed. Thus, when the coil of the contactor unit is energized, the circuits through the contactor unit are completed to all of the branch circuits on the intrusion warning system and current flows to all of the branch circuits and any lights, appliances, alarms, or other electrical devices on any of the branch circuits. Thus, if not turned off or disconnected, the electrical devices on the branch circuits of the multi-functional intrusion warning system are energized and will come on when the occurrence detection unit detects an occurrence.

As with the first embodiment, this feature of the second embodiment of the multi-functional intrusion warning system gives the occupant of the building, such as a homeowner, the option of turning on or plugging in selected lights, televisions, radios, appliances, plug-in alarm devices, pulse lights and/or other electrical devices, associated with the branch circuits of the intrusion warning system, prior to arming the multi-functional intrusion warning system and leaving the building or going to sleep, etc. The electrical devices left on or turned off on the branch circuits is at the discretion of the occupant and can be varied each time the multi-functional intrusion warning system is armed. Once the desired electrical devices on the branch circuits of the intrusion warning system are turned on, the occupant arms the multi-functional intrusion warning system. If a bypass line or lines are provided which normally bypass the control unit to provide power to the branch circuits of the multi-functional intrusion warning system when the multi-functional intrusion warning system is not in use, the bypass switch or switches are opened to shut off power to these branch circuits through the bypass lines. Upon the detection of an occurrence, e.g. a motion detector detecting an intruder or the occupant returning to the building, current is returned to the branch circuits on the system and the electrical devices, such as lights, come back on to frighten away an intruder or to provide light for the returning occupant. In this example, if upon returning to the building, the occupant sees that the lights are already turned on, the occupant will know that something or someone has activated the intrusion warning system and the occupant can then take the necessary precautionary measures. As with the first embodiment of the multi-functional intrusion warning system, if the intrusion warning system has not been activated in the occupant's absence, the intrusion warning system can also function as a convenience device for the occupant. Upon the occupant's return home, the occurrence detector (e.g. a motion detector detecting the motion of the occupant or the raising of the garage door or a telephone or signal activated occurrence detector activated by a telephone call or a hand held control unit) activates the intrusion warning system to light the house for the occupant before the occupant enters the house.

DESCRIPTION OF THE PREFERRED EMBODIMENTS

Figure 1:
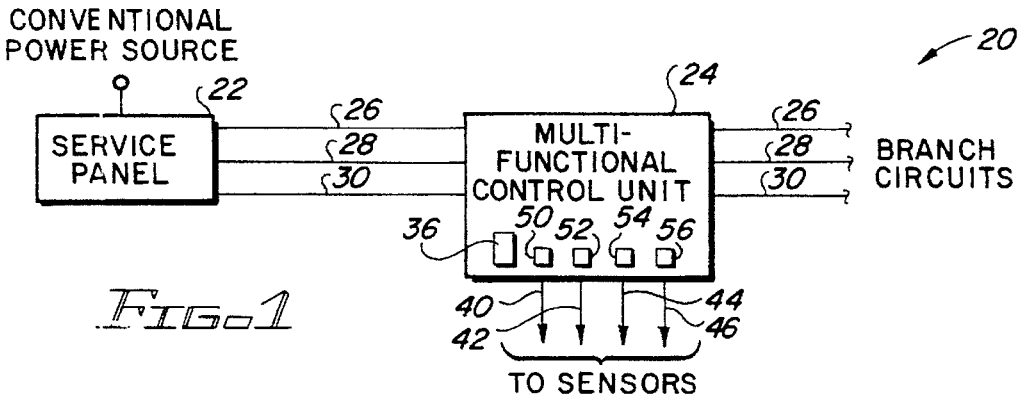
FIG. 1 is a schematic diagram of a building circuitry equipped with the multi-functional intrusion warning system of the present invention.

FIG. 1 is a schematic diagram of building circuitry 20 incorporating the multi-functional intrusion warning system of the present invention. As shown, the building circuitry comprises an AC power source, a service panel 22, a multi-functional control unit 24, and branch circuits 26, 28 and 30. While only three branch circuits are shown for the purposes of illustration, it is to be understood that the building circuitry 20 could have any number of branch circuits and that all or only selected total or partial branch circuits can be controlled by the multi-functional control unit 24 of the multi-functional intrusion warning system. The branch circuits, selected to be controlled by the multi-functional control unit 24, can be selected for their particular function, such as but not limited to, inside lighting for one or more rooms within the building, garage lighting, external lighting such as security lighting by an entryway, receptacles for certain appliances, plug-in or other alarms, or other electrical devices, or combinations of these functions, in accordance with the needs of the occupant. By using the electric outlets, such as electric receptacles and sockets, of the branch circuits to which lighting fixtures, lamps, radios, televisions and other electrical appliances are normally connected as part of the multi-functional intrusion warning system of the present invention, the occupant of the building has a great variety of options for providing a warning that an occurrence, such as an intrusion onto the premises, has taken place.

The circuitry of the building, which forms part of the multi-functional intrusion warning system of the present invention, is the circuitry that the building would normally have to provide the typical or necessary AC services for the building. Thus, the AC circuitry of the building, which would be included in the building whether or not the multi-functional intrusion warning system is used in the building, forms part of the multi-functional intrusion warning system of the present invention and thereby serves both its normal function as an AC power source for the various rooms and locations in and about the building as well as a part of the multi-functional intrusion warning system. In other words, the branch circuits on the multi-functional intrusion warning system of the present invention normally function as branch circuitry providing AC power for the building services used by the occupant in the everyday occupancy of the building. Special wiring, independent of the AC circuitry for the building and especially installed only for an alarm system is not required for the multi-functional intrusion warning system of the present invention.

The service panel 22 is a conventional service panel connected to a conventional AC power source (e.g. 120 volt) and providing power to the three branch circuits 26, 28 and 30. The service panel is equipped with a fuse, a circuit breaker or other means for each branch circuit to break the circuit to any branch circuit experiencing a current surge beyond a certain level. As indicated above, if the current in any part of a branch circuit surges to a dangerously high level a fuse will melt to break the circuit or a circuit breaker, using an electromagnetic switch activated by the current surge, will open to break the circuit. In the building circuitry of the present invention, the branch circuits 26, 28 and 30, to be controlled by the multi-functional control unit 24, pass from the service panel 22 to the multi-functional control unit 24 and from the multi-functional control unit to the locations within or outside the building being serviced by the branch circuits 26, 28 and 30. Thus, the multi-functional control unit 24 controls the electrical power to these branch circuits.

Figure 2:
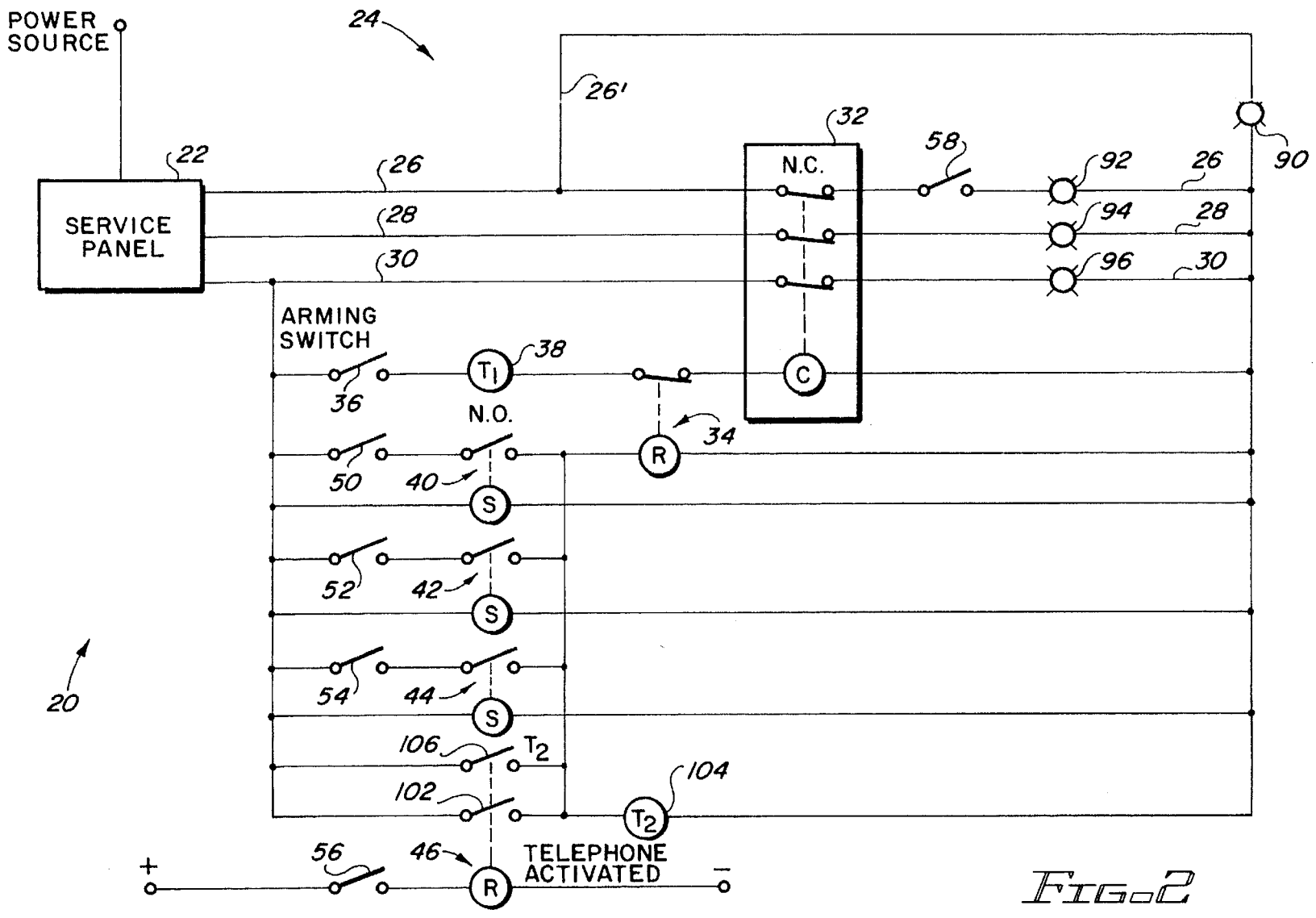
FIG. 2 is a schematic diagram of a building circuitry, equipped with the multi-functional intrusion warning system of the present invention, which shows, in detail, a first embodiment of the multi-functional control unit of the intrusion warning system.

FIG. 2 illustrates one embodiment of the multi-functional intrusion warning system of the present invention. The system comprises the multi-functional control unit 24 which is provided with one or more occurrence detection units and is located in the building circuitry 20 intermediate the fuses or circuit breakers of the service panel 22 and the AC loads of the branch circuits 26, 28 and 30 being controlled by the multi-functional control unit. As shown, the multi-functional control unit 24 comprises a contactor unit 32; a control relay 34 for controlling the contactor unit 32; an arming switch 36; a timer 38; occurrence detection units 40, 42, 44 and 46; and sensor activation switches 50, 52, 54, and 56, respectively, for the occurrence detection units 40, 42, 44 and 46.

In the embodiment of FIG. 2, the contactor unit 32 comprises a coil "C" and a plurality of normally closed contacts for permitting current to flow from the service panel 22 to the loads on the branch circuits 26, 28 and 30. There is one set of contacts for each branch circuit. When the coil "C" of the contactor unit 32 is energized, the contacts of the contactor unit 32 are opened to break the circuits of the branch circuits 26, 28 and 30 and thereby shut off any electrical devices on the branch circuits which are turned on at the time the coil "C" is energized. When the coil "C" of the contactor unit 32 is de-energized by means of the multi-functional control unit 24, a power failure, or malfunction of the multi-functional control unit 24, the contacts of the contactor unit return to their normally closed state thereby closing the branch circuits and permitting current to flow from the service panel 22 to the branch circuits to power any electrical devices on the branch circuits 26, 28 and 30 which are turned on. An example of a contactor unit 32 that can be used in the multi-functional control unit 24 of the present invention is a "SQUARE D" multi-pole contactor unit.

As shown in FIG. 2, one or more of the branch circuits can be divided so that the power to a portion of the branch circuit is not controlled through the contactor unit 32. As shown, the power to one or more AC loads 90 on a portion 26' of branch circuit 26 is not controlled through the contactor unit 32. A switch 58 in branch circuit 26 enables the power to a portion of branch circuit 26 and the AC loads 92 on that portion of the branch circuit 26 to be interrupted. The switch 58 can be located on the multi-functional control unit 24, as shown in FIG. 1, or at some other convenient location within the building. With the switch 58, a portion of the branch circuit 26 with a particular AC load or loads 92, e.g. a plurality of exterior pulse lights located on each side of the building, an alarm, etc., can be included in the multi-functional intrusion warning system by closing the switch 58 when arming the intrusion warning system. Thus, if an intrusion or other occurrence is detected, when the intrusion warning system is in use, the pulse lights, alarm, etc. will come on. However, by normally maintaining the switch 58 open, AC power to the load or loads 92 is interrupted and other AC loads on the portion 26' of the branch circuit 26, such as lights, appliances, radios etc., can be used without operating the AC load or loads 90, such as the pulse lights, alarms which the occupant would not want to have operating under normal circumstances.

While, for purposes of illustration, only branch circuit 26 is shown as divided into two portions 26 and 26' or parallel circuits, it is understood that any or all of the branch circuits 26, 28 and 30 can be divided in this manner. This feature of the multi-functional intrusion warning system can be easily included in the normal circuitry of buildings, e.g homes, etc. under construction at little or substantially no additional expense. In most situations, only one branch circuit would need to be divided in this manner to permit the inclusion of pulse lights, alarms and/or other AC powered devices on the branch circuit of the multi-functional warning system which the occupant would want de-energized under normal circumstances, such as when the building is occupied, but capable of being powered by the intrusion warning system when the occupant is away or asleep, etc.

Figure 3:
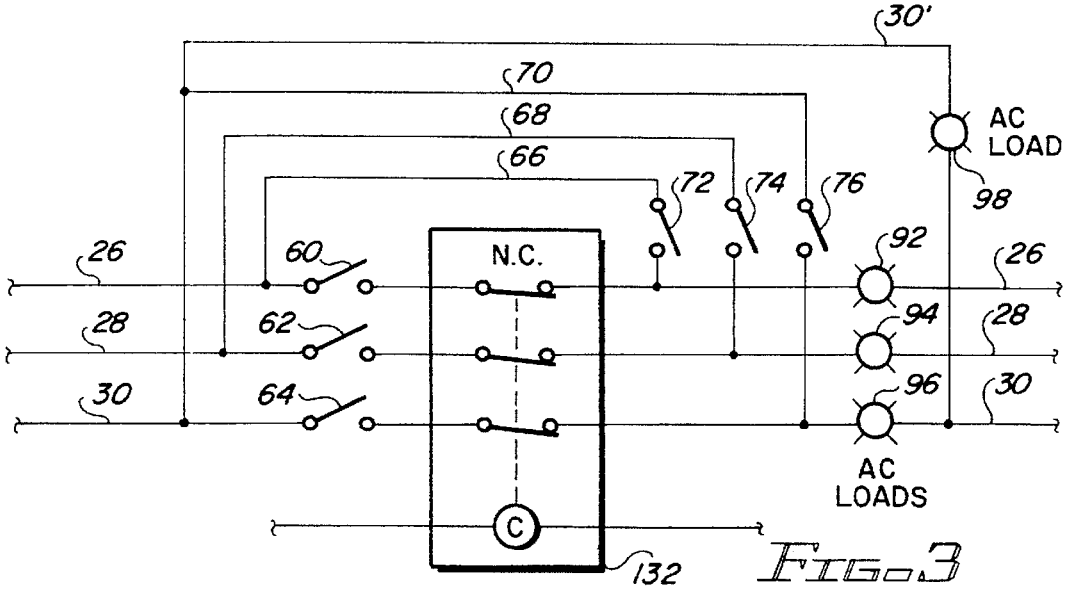
FIG. 3 is a partial schematic diagram of the first embodiment of the multi-functional control unit of the intrusion warning system of the present invention provided with switches which permit any one of the branch circuits on the intrusion warning system to be excluded from the contactor unit.

FIG. 3 is a schematic diagram of a modified contactor unit 132, which can be used in the multi-functional control unit 24. The contactor unit 132 permits any one or all of the branch circuits 26, 28 and 30, connected to the multi-functional control unit 24, to bypass the control unit and specifically the contactor unit 132 of the multi-functional control unit 24. The contactor unit 132 is provided with on-off switches 60, 62 and 64 which can be independently closed to complete the branch circuits 26, 28 and/or 30 through the contacts of the contactor unit 132 or independently opened to interrupt the branch circuits 26, 28 and/or 30 through contactor unit 132. The multi-functional control unit 24 is also provided with bypass lines 66, 68 and 70 with on-off switches 72, 74 and 76, respectively. The on-off switches 72, 74 and 76 can be independently closed to complete the circuits through the bypass lines 66, 68 and/or 70 or independently opened to interrupt the circuits through the bypass lines 66, 68 and/or 70. When one or all of the switches 60, 62 and 64 are closed and the corresponding switches 72, 74 and 76 on the bypass lines are opened, the bypass circuit(s) 66, 68 and/or 70 controlled by these particular switches, are interrupted and power to the AC loads 92, 94 and/or 96 is controlled through the contactor unit 132. When one or all of the switches 60, 62 and 64 are opened and the corresponding switch or switches 72, 74 and 76 on the bypass line(s) are closed, the circuits through the contacts of the contactor unit 132 for the particular branch circuit(s), are interrupted; the circuits through the bypass lines 66, 68 and 70 are complete; and power to the AC loads 92, 94 and/or 96 is not controlled by the contactor unit for those branch circuits having the switches in these states. Thus, even though a branch circuit is included in the multi-functional intrusion warning system of the present invention, the multi-functional control unit 24 can be bypassed for any branch circuit at the building occupants discretion.

Figure 4:
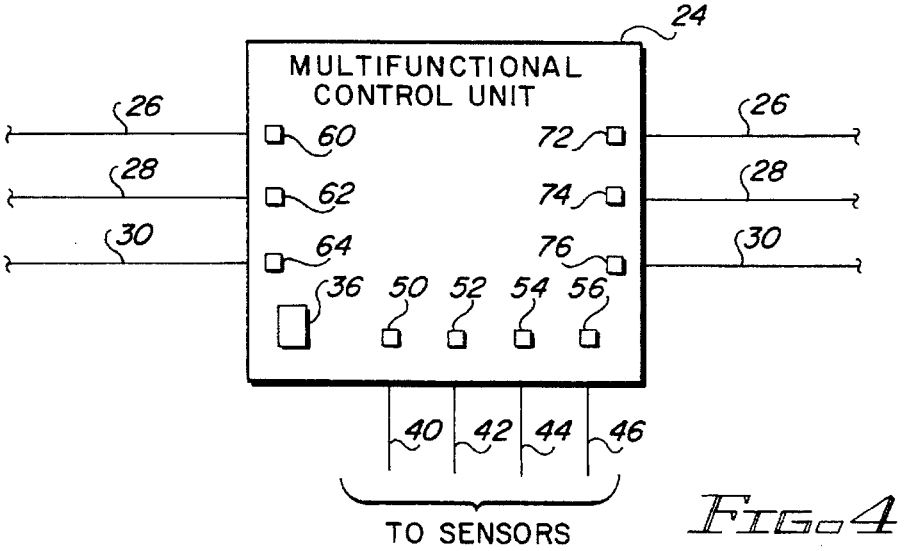
FIG. 4 is a schematic of a housing for a multi-functional control unit of the type shown in FIG. 3, with switches to permit any one of the branch circuits to be excluded from the contactor unit.

As shown in FIG. 3, a portion of branch circuit 30 is divided into two parallel circuits 30 and 30'. Thus, the power to AC load or loads 98 on the portion 30' of branch circuit 30 is not controlled through the contactor unit 132. Thus, a portion of any branch circuit can be isolated from the multi-functional intrusion warning system. This feature is particularly easy to include in the circuitry of newly constructed buildings. FIG. 4 shows a typical housing for the multi-functional control unit 24 using the contactor unit 132 of FIG. 3.

The control relay 34 is a conventional relay having contacts which are normally closed when the relay is not energized. Thus, when the relay 34 is not energized, the contacts of the relay are closed and current can pass through the relay to energize the coil "C" of the contactor unit 32 or 132 to interrupt or break the circuits of the branch circuits on the contactor unit. As shown in FIG. 2, the control relay 34 is connected to a circuit which can be closed by any of the occurrence detection units 40, 42, 44 or 46, in use, when any of these occurrence detection units detect an occurrence. Thus, the detection of an occurrence by one of the detection units will cause the relay 34 to be de-energized thereby opening the contacts of the relay to de-energize the contactor unit 32 or 132 and close the contacts of the contactor unit to allow current to flow to the branch circuits on the multi-functional intrusion warning system.

As shown in FIG. 2, the multi-functional control unit 24 is provided with an arming switch 36 to close the circuit to the coil "C" of the contactor unit 32 or 132 and arm the system by breaking or interrupting the circuits of the branch circuits on the system. A conventional timer 38, such as an "AGA-STAT" timer, may be provided to delay the arming of the multi-functional control unit 24 of the intrusion warning system after the arming switch is closed and give the occupant time to exit the building or leave the location of the multi-functional control unit 24.

The occurrence detection units 40, 42, 44 and 46 can be any of numerous commercially available detection units, such as but not limited to, motion, sound, smoke, infrared, photocell, telephone call or radio signal activated, and/or other commercially available detection devices. The detection units 40, 42, 44 and 46 can be AC or DC powered units and can use batteries as a primary or backup power source. The contacts of the detection units 40, 42, 44 and 46 are normally open, but upon the detection of an occurrence, the contacts of the detection unit(s) are closed to disarm the multi-functional control unit 24. The closing of the contacts of a detection unit energizes the coil of the control relay 34 and thereby de-energizes the coil of the contactor unit 32 or 132 to allow the contacts of the contactor unit to return to their normally closed state and complete circuits through the contactor unit to the branch circuits on the multi-functional intrusion warning system.

By way of example, a typical detection unit of the multi-functional intrusion warning system can be an AC powered motion detector e.g. a "LEVITON" motion sensor or a DC powered telephone unit e.g. a "BENJAMIN TELE-CODE" relay unit, shown in FIG. 2 as occurrence detection unit 46. While these occurrence detection units are examples of typical detection units, it is contemplated that various commercially available detection units can be used as the occurrence detection units in the multi-functional control system of the present invention depending on the needs of the occupant. In the preferred embodiment of the present invention, should an occurrence detection unit or any component of the multi-functional intrusion warning system fail, the contacts of the contactor unit 32 or 132 always fail to the normally closed position for normal operation of the branch circuits.

The occurrence detection unit 46, shown in FIG. 2, is a conventional relay activated by a telephone call. When the occurrence detection unit 46 is activated by a telephone call, the AC contacts 102 of detection unit 46 are momentarily closed. This energizes the timer 104 which keeps the AC contacts 106 of the detection unit 46 closed for a preselected period of time to energize the coil of the control relay 34 and disarm the system to provide power to the branch circuits. At the end of this time period, the timer 104 opens the AC contacts 106 and the coil of the control relay 34 is de-energized to rearm the system and interrupt the power to the branch circuits. Thus, an occupant of the building, such as a homeowner, by having the lighting on the branch circuits turned on, can have the lights come on prior to his/her return by activating the occurrence detector 46. If the homeowner does not return home within the time period set by the timer 104, the multi-functional intrusion warning system is rearmed and the power to the branch circuits is interrupted turning off the lighting on the branch circuits. The system is thus reset as an intrusion warning system.

The occurrence detection units 40, 42, 44 and 46 can be mounted at various locations within and outside the building depending on the occurrence to be detected. One preferred location and detection unit for the system, especially if only one detection unit is used on a basic, low cost model of the multi-functional intrusion warning system, is an AC powered motion detection unit placed in the garage of a home or residence, which will detect the movement of the garage door and anyone in the garage and energize the relay 34 and cause the contactor unit 32 or 132 to be de-energized to return power to any of the branch circuits 26, 28 and 30 on the system (not bypassing the contactor unit through the use of one of the bypass lines 66, 68 or 70).

Thus, with the multi-functional intrusion warning system of the present invention, one or more branch circuits of a building, such as a home, residence or other building, can be used as a pre-warning alarm to alert a returning or sleeping homeowner or occupant, by lights, alarms, etc., that a certain occurrence has been detected in or about the occupants home or building. Each time the occupant arms the multi-functional control unit 24, the occupant can determine which branch circuits are to be armed by the multi-functional control system (contactor unit 132); which and what types of electrical devices are to be activated when the power is returned to the branch circuits on the multi-functional intrusion warning system; and which occurrence detection units are to be activated for use in the multi-functional intrusion warning system.

The electrical devices on the branch circuits which are to be powered by the detection of an occurrence by the multi-functional intrusion warning system can be turned on by the occupant prior to arming the multi-functional intrusion warning system. Thus, the occupant will be aware of what electrical devices are included in the intrusion warning system prior to leaving the building, going to sleep, etc. For example, someone who is hearing impaired could have only lights come on if desired. As a convenience and as a forewarning of a potential problem or intruder, a homeowner could have all or certain of the interior and/or exterior lights come on when motion is detected at the entryways or in or about the garage of a home. With this setup, the returning occupant, upon seeing a house with lights on, is aware that some occurrence has been detected to return power to the branch circuits of the home. If the house is still dark upon the return of the occupant, the return of the occupant to the home can set off the detector and the occupant can walk into a house which is wholly or partially lighted. As discussed above, some embodiments of the intrusion warning system can be activated by telephone or a radio signal to allow the occupant to return to a lighted home. These are but a few of the many options which a building occupant has with the multi-functional intrusion warning system of the present invention and are not meant to be limiting.

Figure 5:
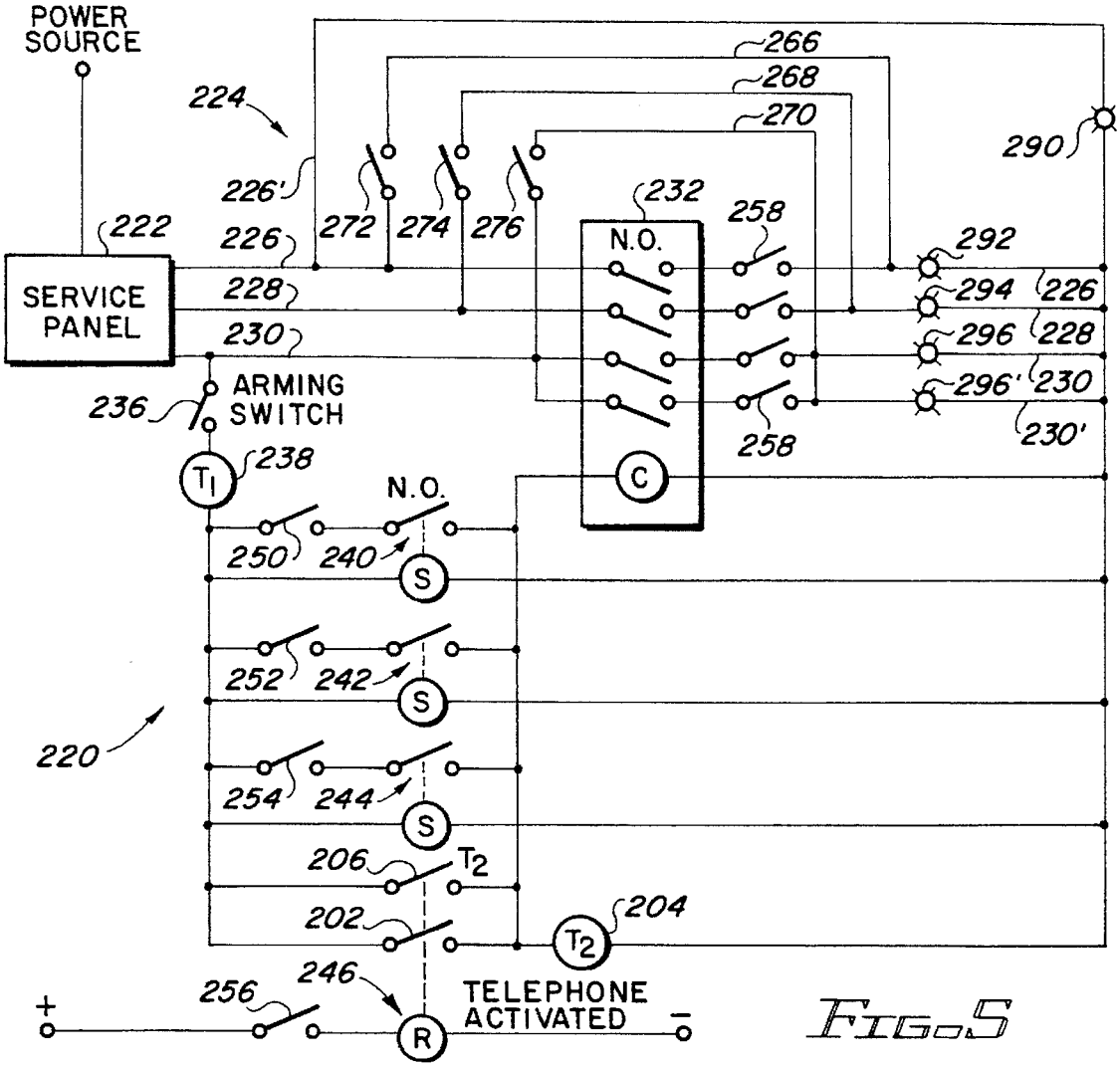
FIG. 5 is a schematic diagram of a building circuitry equipped with the second embodiment of the multi-functional intrusion warning system of the present invention and including in its control unit switches which permit any one or more of the branch circuits on the intrusion warning system to be selectively excluded from control by the contactor unit and bypass lines which permit the contactor unit of the multi-functional control unit to be bypassed.

FIG. 5 is a schematic diagram of a building circuitry 220 incorporating the second embodiment of the multi-functional intrusion warning system of the present invention. As shown, the building circuitry comprises an AC power source, a service panel 22, a multi-functional control unit 224, and branch circuits 226, 228 and 230. While only three branch circuits are shown for the purposes of illustration, it is to be understood that the building circuitry 220 could have any number of branch circuits and that all or only selected, total or partial, branch circuits can be controlled by the multi-functional control unit 224 of the multi-functional intrusion warning system. As with the first embodiment, the branch circuits, selected to be controlled by the multi-functional control unit 224, can be selected for their particular function, such as but not limited to, inside lighting for one or more rooms within the building, garage lighting, external lighting such as security lighting by an entryway, receptacles for certain appliances, plug-in or other alarms, or other electrical devices, or combinations of these functions, in accordance with the needs of the occupant. By using the electric outlets, such as electric receptacles and sockets, of the branch circuits to which lighting fixtures, lamps, radios, televisions and other electrical appliances are normally connected as part of the multi-functional intrusion warning system of the present invention, the occupant of the building has a great variety of options for providing a warning that an occurrence, such as an intrusion onto the premises, has taken place.

The circuitry of the building, which forms part of the multi-functional intrusion warning system of the present invention, is the circuitry that the building would normally have to provide the typical or necessary AC services for the building. Thus, the AC circuitry of the building, which would be included in the building whether or not the multi-functional intrusion warning system is used in the building, forms part of the multi-functional intrusion warning system of the present invention and thereby serves both its normal function as an AC power source for the various rooms and locations in and about the building as well as a part of the multi-functional intrusion warning system. In other words, the branch circuits on the multi-functional intrusion warning system of the present invention normally function as branch circuitry providing AC power for the building services used by the occupant in the everyday occupancy of the building. Special wiring, independent of the AC circuitry for the building and especially installed only for an alarm system is not required for the multi-functional intrusion warning system of the present invention. However, if desired, in certain situations, such as remodeling or new home or building construction, a dedicated security branch circuit or circuits could be included in the building circuitry.

The service panel 222 is a conventional service panel connected to a conventional AC power source (e.g. 120 volt) and providing power to the three branch circuits 226,228 and 230. The service panel is equipped with a fuse, a circuit breaker or other means for each branch circuit to break the circuit to any branch circuit experiencing a current surge beyond a certain level. As indicated above, if the current in any part of a branch circuit surges to a dangerously high level a fuse will melt to break the circuit or a circuit breaker, using an electromagnetic switch activated by the current surge, will open to break the circuit. In the building circuitry of the present invention, the branch circuits 226, 228 and 230, to be controlled by the multi-functional control unit 224, pass from the service panel 222 to the multi-functional control unit 224 and from the multi-functional control unit to the locations within or outside the building being serviced by the branch circuits 226, 228 and 230. Thus, the multi-functional control unit 224 controls the electrical power to these branch circuits.

Figure 6:
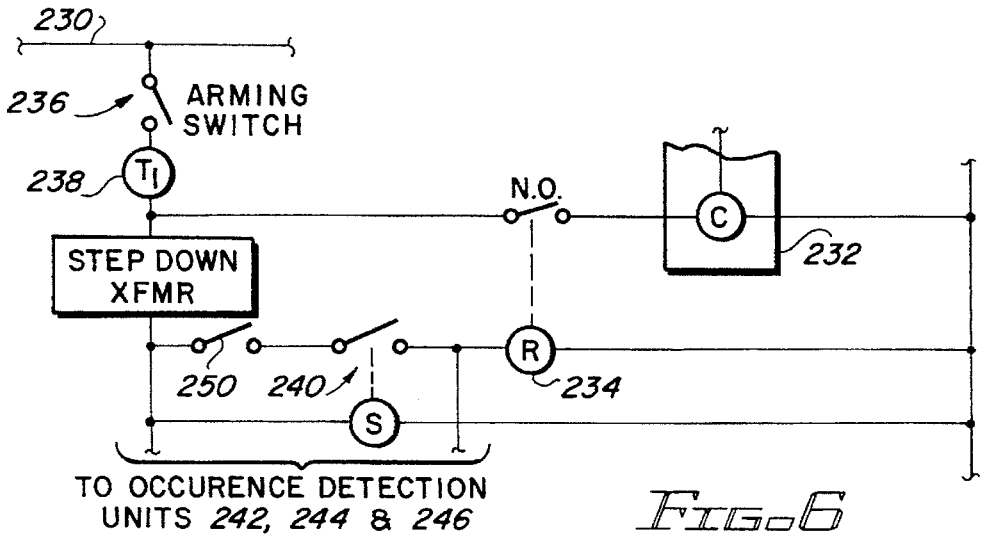
FIG. 6 is a schematic diagram of a modified version of the multi-functional control unit of FIG. 5 equipped with a control relay.

The multi-functional intrusion warning system of FIG. 5 Comprises the multi-functional control unit 224 which is provided with one or more occurrence detection units and is located in the building circuitry 220 intermediate the fuses or circuit breakers of the service panel 222 and the AC loads of the branch circuits 226, 228 and 230 being controlled by the multi-functional control unit. As shown, the multi-functional control unit 224 comprises a contactor unit 232; an arming switch 236; a timer 238; occurrence detection units 240, 242, 244 and 246; and sensor activation switches 250, 252, 254, and 256, respectively, for the occurrence detection units 240, 242, 244 and 246. As shown in FIG. 6, the multi-functional control unit 224 can also include a control relay 234 for controlling the contactor unit 232 as well as a step down transformer if needed.

In the embodiment of FIG. 5, the contactor unit 232 comprises a coil "C" and a plurality of normally open contacts for interrupting the current flow from the service panel 222 to the loads on the branch circuits 226, 228 and 230. There is one set of contacts for each branch circuit 226 and 228 and two sets of contacts for branch circuit 230 which is divided into two parallel sub-circuits. When the coil "C" of the contactor unit 232 is energized, the contacts of the contactor unit 232 are closed to complete the circuits of the branch circuits 226, 228 and 230 and thereby provide power to any electrical devices on the branch circuits which are turned on at the time the coil "C" is energized. When the coil "C" of the contactor unit 232 is de-energized by means of the multi-functional control unit 224, the contacts of the contactor unit return to their normally open state thereby interrupting the circuits through the contactor unit 232 to the branch circuits and shutting off power through the contactor unit to any electrical devices on the branch circuits 226, 228 and 230. An example of a contactor unit 232 that can be used in the multi-functional control unit 224 of the present invention is a "SQUARE D" multi-pole contactor unit.

As shown in FIG. 5, one or more of the branch circuits can be divided so that the power to a portion of the branch circuit is not controlled through the contactor unit 232. As shown, the power to one or more AC loads 290 on a portion 226' of branch circuit 226 is not controlled through the contactor unit 232. In addition, bypass lines 266, 268 and 270 can be provided, preferably in the multi-functional control unit, to bypass the contactor unit 232 so that the branch circuits 226, 228 and 230 can be used as normal branch circuits of the building when the multi-functional intrusion warning system is not in use. Switches 272, 274 and 276 can be closed for daily or normal use of the branch circuits and opened when the multi-functional intrusion warning system is to be armed.

If desired, a series of separate switches 258 can be included, preferably in the multi-functional control unit 224, to interrupt the circuits through the contactor unit 232 to the branch circuits 226, 228 and 230 so that the power to one or more of the AC loads 292, 294 and 296 on those portions of the branch circuits will not be controlled by the multi-functional control unit.

While, for purposes of illustration, only branch circuit 226 is shown as divided into two portions 226 and 226' or parallel circuits with one portion 226' of the branch circuit not controlled by the multi-functional control unit 224, it is understood that any or all of the branch circuits 226, 228 and 230 can be divided in this manner. Also, while only branch circuit 230 is shown divided into two portions 230 and 230' or parallel circuits controlled by the multi-functional control unit 224, it is understood that any or all of the branch circuits 226, 228 and 230 can be divided in this manner as well as the branch circuits of FIG. 2. This feature of the multi-functional intrusion warning system can be easily included in the normal circuitry of buildings, e.g homes, etc. under construction at little or substantially no additional expense.

As shown in FIG. 5, the multi-functional control unit 224 is provided with an arming switch 236 to complete the circuits to the occurrence detection units 240, 242, 244 and 246 and arm the system using any of the occurrence detection units which have been turned on by closing the switches 250, 252, 254 and/or 256 of the detection units. If desired, the switches 250, 252, 254 and/or 256 could be eliminated so that the arming of the system with the arming switch 236 automatically turns on the detection units. A conventional timer 238, such as an "AGA-STAT" timer, may be provided to delay the arming of the multi-functional intrusion warning system after the arming switch 236 is closed and give the occupant time to exit the building or leave the location of the multi-functional control unit 224. As mentioned above, when arming the system, the switches on the bypass lines 266, 268 and/or 270 of the branch circuits being used on the multi-functional intrusion warning system should be opened.

As with the occurrence detection units of the first embodiment, the occurrence detection units 240, 242, 244 and 246 can be any of numerous commercially available detection units, such as but not limited to, motion, sound, smoke, infrared, photocell, telephone call or radio signal activated, and/or other commercially available detection devices. The detection units 240,242, 244 and 246 can be AC or DC powered units and can use batteries as a primary or backup power source. The contacts of the detection units 240, 242, 244 and 246 are normally open, but upon the detection of an occurrence, the contacts of the detection unit(s) are closed. The closing of the contacts of a detection unit completes the circuit to the coil of the contactor unit 232 to thereby energize the coil of the contactor unit 232; close the contacts of the contactor unit; and complete circuits through the contactor unit to the branch circuits on the multi-functional intrusion warning system.

By way of example, typical occurrence detection units of the multi-functional intrusion warning system can be conventional AC powered motion detectors, such as a "LEVITON" motion sensor or conventional DC powered telephone units, such as a "BENJAMIN TELECODE" relay unit, represented in FIG. 5 as occurrence detection unit 246. The occurrence detection unit 246 is a conventional relay activated by a telephone call. When the occurrence detection unit 246 is activated by a telephone call, the AC contacts 202 of detection unit 246 are momentarily closed. This energizes the timer 204 which keeps the AC contacts 206 of the detection unit 246 closed for a preselected period of time to energize the coil of the contactor unit 232 to close the contacts of the contactor unit and provide power to the branch circuits. At the end of this time period, the timer 204 opens the AC contacts 206 and the coil of the contactor unit is de-energized to open the contacts of the contactor unit and interrupt the power to the branch circuits. Thus, an occupant of the building, such as a homeowner, by having the lighting on the branch circuits turned on, can have the lights come on prior to his/her return by activating the occurrence detector 246. If the homeowner does not return home within the time period set by the timer 204, the power to the branch circuits is interrupted turning off the lighting on the branch circuits. The system is thus reset as an intrusion warning system. While these occurrence detection units are examples of typical detection units, it is contemplated that various commercially available AC and DC occurrence detection units can be used as the occurrence detection units in the multi-functional control system of the present invention depending on the needs of the occupant.

The occurrence detection units 240, 242, 244 and 246 can be mounted at various locations within and outside the building depending on the occurrence to be detected. One preferred location and detection unit for the system, especially if only one detection unit is used on a basic, low cost model of the multi-functional intrusion warning system, is an AC powered motion detection unit placed in the garage of a home or residence, which will detect the movement of the garage door and anyone in the garage and energize the relay 234 and cause the contactor unit 232 to be energized to return power to any of the branch circuits 226, 228 and 230 on the system.

FIG. 6 shows a portion of the circuitry of the second embodiment of the multi-functional intrusion warning system of FIG. 5 which has been modified to include the control relay 234. The control relay 234 is a conventional relay having contacts which are normally open when the relay is not energized. Thus, when the relay 234 is not energized, the contacts of the relay are open and current can not pass through the relay to energize the coil "C" of the contactor unit 232 to close the contacts of the contactor unit 232 and complete the circuits of the branch circuits on the contactor unit. As shown in FIG. 6, the coil of the control relay 234 is connected to a circuit which can be completed by any of the occurrence detection units 240, 242, 244 or 246, in use, when any of these occurrence detection units detect an occurrence. Thus, the detection of an occurrence by one of the detection units will cause the coil of the relay 234 to be energized thereby closing the contacts of the relay to energize the coil of the contactor unit 232 and close the contacts of the contactor unit to allow current to flow to the branch circuits on the multi-functional intrusion warning system. The coil of the control relay 234 can be either an AC coil or a DC coil of various voltages as required for the system. As shown a step down transformer can also be included in the circuitry, if needed or desired, to accommodate the occurrence detection units. Other than including the use of the control relay 234 and possibly, the step down transformer, the multi-functional intrusion warning system of FIG. 6 functions the same as the system of FIG. 5.

Thus, as with the first embodiment of the multi-functional intrusion warning system of the present invention, one or more branch circuits of a building, such as a home, residence or other building, can be used as a pre-warning alarm to alert a returning or sleeping homeowner or occupant, by lights, alarms, etc., that a certain occurrence has been detected in or about the occupants home or building. Each time the occupant arms the multi-functional control unit 224, the occupant can determine which branch circuits are to be armed by the multi-functional control system (contactor unit 232); which and what types of electrical devices are to be activated when the power is returned to the branch circuits on the multi-functional intrusion warning system; and which occurrence detection units are to be activated for use in the multi-functional intrusion warning system.

The electrical devices on the branch circuits which are to be powered by the detection of an occurrence by the multi-functional intrusion warning system can be turned on by the occupant prior to arming the multi-functional intrusion warning system. Thus, the occupant will be aware of what electrical devices are included in the intrusion warning system prior to leaving the building, going to sleep, etc. For example, someone who is hearing impaired could have only lights come on if desired. As a convenience and as a forewarning of a potential problem or intruder, a homeowner could have all or certain of the interior and/or exterior lights come on when motion is detected at the entryways or in or about the garage of a home. With this setup, the returning occupant, upon seeing a house with lights on, is aware that some occurrence has been detected to return power to the branch circuits of the home. If the house is still dark upon the return of the occupant, the return of the occupant to the home can set off the detector and the occupant can walk into a house which is wholly or partially lighted. As discussed above, some embodiments of the intrusion warning system can be activated by telephone or a radio signal to allow the occupant to return to a lighted home. These are but a few of the many options which a building occupant has with the multi-functional intrusion warning system of the present invention and are not meant to be limiting.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A multi-functional intrusion warning system for a building and the like having a conventional AC power source comprising:

building circuitry for providing AC power to the building electrical services; said building circuitry comprising a plurality of branch circuits;

a circuit breaking means in said building circuitry intermediate said AC power source and said plurality of branch circuits for cutting off electrical current to any branch circuit of said plurality of branch circuits experiencing a current surge above a certain level;

a circuit interrupting means in said building circuitry intermediate said circuit breaking means and at least one branch circuit of said plurality of branch circuits comprising contactor means in a circuit intermediate said circuit breaking means and said at least one branch circuit; said contactor means having normally open contacts when said circuit interrupting means is de-energized to interrupt said circuit through said contactor means between said circuit breaking means and said at least one branch circuit; said contactor means having closed contacts when said circuit interrupting means is energized to complete said circuit through said contactor means between said circuit breaking means and said at least one branch circuit;

a circuit to said circuit interrupting means for energizing, when complete, said circuit interrupting means to close said contacts of said contactor means and thereby complete said circuit through said contactor means and thereby permit power to flow through the contactor means to said at least one branch circuit; and control means normally interrupting said circuit to said circuit interrupting means which upon a certain occurrence completes said circuit to said circuit interrupting means to energize said circuit interrupting means and close said contacts of said contactor means to complete said circuit through the contactor means and permit power to flow from said circuit breaking means to said at least one branch circuit to power electrical devices on said at least one branch circuit to provide a warning through the powering of said electrical devices that a certain occurrence has been detected by the multi-functional intrusion warning system.

2. The multi-functional intrusion warning system for a building and the like according to claim 1, wherein: said control means for completing said circuit to said circuit interrupting means to energize said circuit interrupting means and permit current to flow from said circuit breaking means to said at least one branch circuit comprises an occurrence detection means whereby when an occurrence is detected by said occurrence detection means said circuit interrupting means is energized and current is supplied to said at least one branch circuit to power electrical devices on said at least one branch circuit.

3. The multi-functional intrusion warning system for a building and the like according to claim 2, wherein: said occurrence detection means is selected from a group comprising: motion, sound, smoke, infrared, photocell, telephone activated or radio signal activated detection means.

4. The multi-functional intrusion warning system for a building and the like according to claim 1, wherein:

said circuit interrupting means is in said building circuitry intermediate said circuit breaking means and at least two of said plurality of branch circuits; and said contactor means of said circuit interrupting means is in circuits intermediate said circuit breaking means and said at least two of said plurality of branch circuits; said contacts of said contactor means are open, when said circuit interrupting means is de-energized, to interrupt said circuits through said contactor means between said circuit breaking means and said at least two of said plurality of said branch circuits and said contacts of said contactor means are closed, when said circuit interrupting means is energized, to complete said circuits through said contactor means between said circuit breaking means and said at least two of said plurality of said branch circuits.

5. The multi-functional intrusion warning system for a building and the like according to claim 4, wherein: said control means for completing said circuit to said circuit interrupting means to energize said circuit interrupting means and permit current to flow from said circuit breaking means to said at least two of said plurality of said branch circuits comprises an occurrence detection means whereby when an occurrence is detected by said occurrence detection means said circuit interrupting means is energized and current is supplied to said at least two of said plurality of said branch circuits to power electrical devices on said at least two of said plurality of said branch circuits.

6. The multi-functional intrusion warning system for a building and the like according to claim 5, wherein: said occurrence detection means is selected from a group comprising: motion, sound, smoke, infrared, photocell, telephone activated or radio signal activated detection means.

7. The multi-functional intrusion warning system for a building and the like according to claim 5, wherein: said occurrence detection means comprises a telephone call activated relay with a timing means for energizing said circuit interrupting means for a preselected period of time.

8. The multi-functional intrusion warning system for a building and the like according to claim 4, including: means for selectively bypassing said circuit interrupting means to complete a circuit between said circuit breaking means and at least one of said at least two of said plurality of branch circuits.

9. The multi-functional intrusion warning system for a building and the like according to claim 4, including: means for selectively interrupting the circuit of at least one of said at least two of said plurality of branch circuits intermediate said contactor means and electrical devices on said at least one of said at least two of said plurality of branch circuits.

10. The multi-functional intrusion warning system for a building and the like according to claim 1, wherein: said control means for completing said circuit to said circuit interrupting means upon a certain occurrence to energize said circuit interrupting means includes a control relay with normally open contacts which are closed upon detection of said occurrence to energize said circuit interrupting means.

11. The multi-functional intrusion warning system for a building and the like according to claim 1, wherein: said at least one branch circuit comprises one circuit, divided into two parallel circuits which pass through said contactor means which controls power to electrical devices on said two parallel circuits.

12. The multi-functional intrusion warning system for a building and the like according to claim 1, wherein: said control means includes a motion detector means in a garage of said building for detecting movement in said garage including movement of a garage door, to activate said control means to complete said circuit to said circuit interrupting means to energize said contactor means and permit current to flow from said circuit breaking means to said at least one branch circuit.

13. The multi-functional intrusion warning system for a building and the like according to claim 1, wherein: said at least one branch circuit includes electrical outlets and said electrical devices on said at least one branch circuit include electric appliances which are connected to at least some of said electrical outlets.

14. A multi-functional intrusion warning system for a building and the like having a conventional AC power source; building circuitry comprising multiple branch circuits; and a circuit breaking means in said building circuitry intermediate said power source and said branch circuits for cutting off electrical current to any of said branch circuits experiencing a current surge above a certain level, with said multi-functional control system being adapted to be located in said building circuitry intermediate said circuit breaking means and at least one of said branch circuits, comprising:

a circuit interrupting means for location in a circuit intermediate said circuit breaking means and said at least one branch circuit comprising contactor means having normally open contacts, when said circuit interrupting means is de-energized, to interrupt said circuit between said circuit breaking means and said at least one branch circuit and having closed contacts, when said circuit interrupting means is energized, to complete said circuit between said circuit breaking means and said at least one branch circuit;

occurrence detection means for completing said circuit to said circuit interrupting means upon a certain occurrence to energize said circuit interrupting means and permit current to flow from said circuit breaking means to said at least one branch circuit to power electrical devices on said at least one branch circuit; and switch means for completing, when closed, a circuit to said occurrence detection means for energizing and activating said occurrence detection means.

15. The multi-functional intrusion warning system according to claim 14, wherein: said contactor means has closed contacts, when said circuit interrupting means is energized, to complete circuits between said circuit breaking means and a plurality of said branch circuits and has normally open contacts, when said circuit interrupting means is de-energized to interrupt said circuits between said circuit breaking means and said plurality of said branch circuits.

16. The multi-functional intrusion warning system according to claim 15, wherein: said occurrence detection means is selected from a group comprising motion, sound, smoke, infrared, photocell, telephone activated or radio signal activated detection means.

17. The multi-functional intrusion warning system according to claim 16, including: a control relay connected to said occurrence detection means to complete said circuit to said circuit interrupting means to energize said circuit interrupting means and permit current to flow from said circuit breaking means to said plurality of said branch circuits.

18. A method of providing a warning that an occurrence has occurred in a building and the like having an AC power source, building circuitry with a plurality of branch circuits, and a circuit breaking means in said building circuitry intermediate said AC power source and said branch circuits for interrupting electric current to any of said branch circuits experiencing a current surge above a certain level, comprising:

locating a circuit interrupting means intermediate said circuit breaking means and at least one of said branch circuits comprising contactor means in a circuit of said building circuitry intermediate said circuit breaking means and said at least one of said branch circuits which has normally open contacts, when said circuit interrupting means is de-energized, to interrupt said circuit through said contactor means between said circuit breaking means and said at least one of said branch circuits and closed contacts, when said circuit interrupting means is energized, to complete said circuit through said contactor means between said circuit breaking means and said branch circuits;

connecting electric devices to electric outlets of said at least one of said branch circuits;

energizing occurrence detection means which, upon detection of an occurrence, will energize said circuit interrupting means to close said contacts of contactor means to complete said circuits through said contactor means and provide power to said electric devices connected to said at least one of said branch circuits to provide a warning that the occurrence has occurred.

19. The method of claim 18, wherein:

said contactor means of said circuit interrupting means is located in circuits of said building circuitry intermediate said circuit breaking means and at least two of said branch circuits and said contactor means has normally open contacts, when said circuit interrupting means is de-energized, to interrupt said circuits through said contactor means between said circuit breaking means and said at least two of said branch circuits and closed contacts, when said circuit interrupting means is energized, to complete said circuits through said contactor means between said circuit breaking means and said at least two of said branch circuits; and energizing occurrence detection means which, upon detection of an occurrence, will energize said circuit interrupting means to close said contacts of said contactor means to complete said circuits through said contactor means and provide power to said electrical devices connected to said at least two of said branch circuits to provide a warning that an occurrence has occurred.

20. A multi-functional intrusion warning system for a building and the like having a conventional AC power source comprising:

building circuitry for providing AC power to the building electrical services; said building circuitry comprising a plurality of branch circuits;

a circuit breaking means in said building circuitry intermediate said AC power source and said plurality of branch circuits for cutting off electrical current to any branch circuit of said plurality of branch circuits experiencing a current surge above a certain level;

a circuit interrupting means in said building circuitry intermediate said circuit breaking means and at least two branch circuits of said plurality of branch circuits comprising contactor means in circuits intermediate said circuit breaking means and said at least two branch circuits; said contactor means having normally closed contacts when said circuit interrupting means is de-energized to complete said circuits through said contactor means between said circuit breaking means and said at least two branch circuits; said contactor means having open contacts when said circuit interrupting means is energized to interrupt said circuits through said contactor means between said circuit breaking means and said at least two branch circuits;

arming switch means for completing, when closed, a circuit to said circuit interrupting means for energizing said circuit interrupting means to open said contacts of said contactor means and thereby interrupt said circuits through said contactor means and thereby interrupt power through the contactor means to said at least two branch circuits and thereby arm the multi-functional intrusion warning system;

control means for interrupting said circuit to said circuit interrupting means upon a certain occurrence to de-energize said circuit interrupting means and thereby return said contacts of said contactor means to their normally closed state to complete said circuits through the contactor means and permit power to flow from said circuit breaking means to said at least two branch circuits to power electrical devices on said at least two branch circuits to provide a warning through the powering of said electrical devices that a certain occurrence has been detected by the multi-functional intrusion warning system; and said control means for interrupting said circuit to said circuit interrupting means including an occurrence detection means whereby when an occurrence is detected by said occurrence detection means said circuit interrupting means is de-energized.

21. The multi-functional intrusion warning system for a building and the like according to claim 20, wherein: at least one of said at least two branch circuits comprise one circuit, divided into two parallel circuits, which pass through said contactor means which controls power to electrical devices on said two parallel circuits.

* * * * *